US011994318B2

(12) United States Patent
Wu et al.

(10) Patent No.: US 11,994,318 B2
(45) Date of Patent: May 28, 2024

(54) REFRIGERATION SYSTEM

(71) Applicants: QINGDAO HAIER AIR-CONDITIONING ELECTRONIC CO., LTD., Qingdao (CN); HAIER SMART HOME CO., LTD., Qingdao (CN)

(72) Inventors: Chuanzhi Wu, Qingdao (CN); Jie Zhang, Qingdao (CN); Jielei Sui, Qingdao (CN)

(73) Assignees: QINGDAO HAIER AIR-CONDITIONING ELECTRONIC CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 386 days.

(21) Appl. No.: 17/420,714

(22) PCT Filed: Feb. 19, 2019

(86) PCT No.: PCT/CN2019/075417
§ 371 (c)(1),
(2) Date: Jul. 5, 2021

(87) PCT Pub. No.: WO2020/140314
PCT Pub. Date: Jul. 9, 2020

(65) Prior Publication Data

US 2021/0389026 A1 Dec. 16, 2021

(30) Foreign Application Priority Data

Jan. 4, 2019 (CN) ..... 201910008066.8

(51) Int. Cl.
*F25B 1/00* (2006.01)
*F25D 16/00* (2006.01)
*F25D 29/00* (2006.01)

(52) U.S. Cl.
CPC ..... *F25B 1/00* (2013.01); *F25D 16/00* (2013.01); *F25D 29/00* (2013.01)

(58) Field of Classification Search
CPC ..... F25D 17/02; F25D 29/00; F25D 16/00; F25B 41/00; F25B 25/005; F25B 2339/047; F25B 1/00; F24F 5/0071; F24F 3/08
See application file for complete search history.

(56) References Cited

FOREIGN PATENT DOCUMENTS

CN 201463150 U 5/2010
CN 102650476 A 8/2012
(Continued)

*Primary Examiner* — Ana M Vazquez
(74) *Attorney, Agent, or Firm* — Jiwen Chen; Joywin IP Law PLLC

(57) ABSTRACT

A refrigeration system, when a set evaporator water outlet temperature $T_o$ is less than a daily minimum temperature $T_{min}$, starts a cold water unit to cool a cooling pool; when the set evaporator water outlet temperature $T_o$ is greater than a daily maximum temperature $T_{max}$, starts a natural cooling source to cool the cooling pool; when $T_{min} \leq T_o \leq T_{max}$, if $T_i \geq T_o$−a set value, starts the cold water unit to cool the cooling pool, and if $T_i < T_o$−the set value, starts the natural cooling source to cool the cooling pool. The refrigeration system not only satisfies the cooling requirements of the cooling pool, but also achieves the purpose of saving energy, reducing costs.

12 Claims, 1 Drawing Sheet

(56) References Cited

FOREIGN PATENT DOCUMENTS

| | | | | |
|---|---|---|---|---|
| CN | 207936542 U | * | 10/2018 | ..... F25B 25/00 |
| CN | 207936542 U | | 10/2018 | |
| JP | 2000320913 | | 11/2000 | |
| KR | 20060041532 | | 5/2006 | |

* cited by examiner

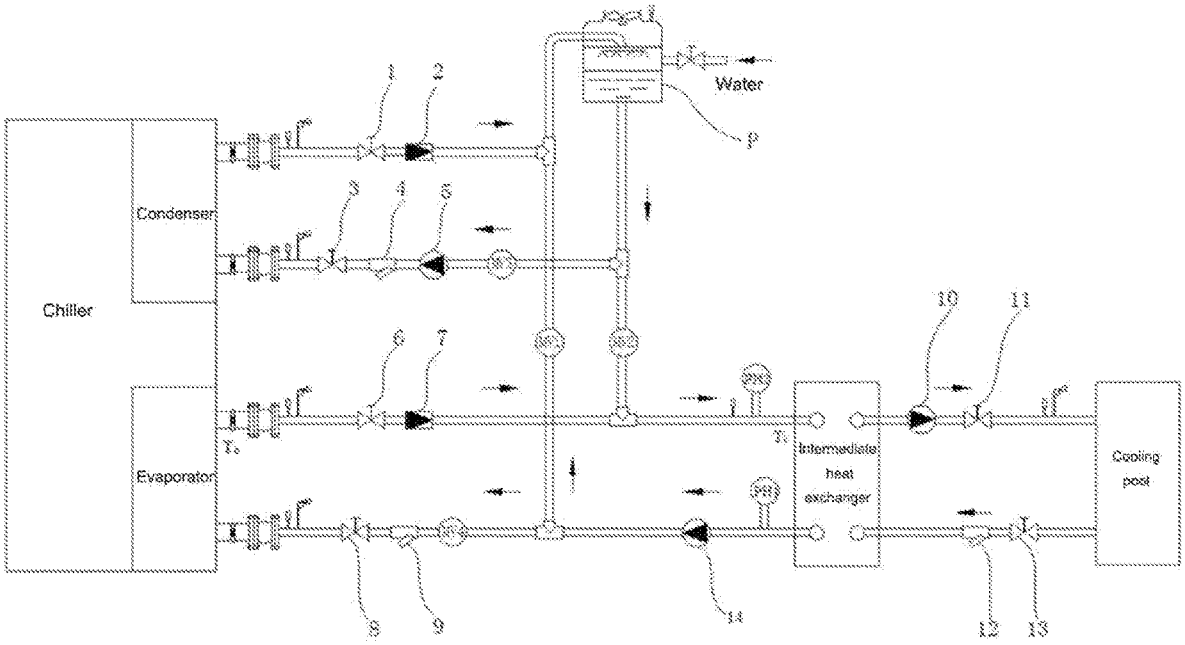
Water
Condenser
Chiller
Evaporator
Intermediate heat exchanger
Cooling pool
1
2
3
4
5
6
7
8
9
10
11
12
13
14

REFRIGERATION SYSTEM

This is a U.S. national stage application of PCT Application No. PCT/CN2019/075417 under 35 U.S.C. 371, filed Feb. 19, 2019 in Chinese, claiming priority to Chinese Patent Application No. 201910008066.8, filed Jan. 4, 2019, all of which are hereby incorporated by reference.

TECHNOLOGY FIELD

The invention belongs to the technical field of refrigeration, and specifically relates to a refrigeration system.

BACKGROUND TECHNOLOGY

In processing aluminum profiles, the material will have been cleared by physical or chemical method to expose pure matrix firstly, and then anodized under a required condition to facilitate formation of a complete, dense, porous anodic film ($Al_2O_3$) with a strong adsorption capability; finally pores on the anodic film formed by anodizing are sealed so as to enhance properties of the anodic film as anti-pollution, corrosion resistance and wear resistance. Steps in processing aluminum profiles include putting aluminum material into a sulfuric acid solution tank and energizing both ends of the aluminum material for 30 minutes approximately (which depends on manufacturers or products) so that the aluminum material is anodized to form an anodic film. In order to ensure the quality of the anodic film, the temperature within the sulfuric acid solution tank should be maintained at 18° C.~22° C. throughout the year. But the energized anodizing treatment process generates a huge amount of heat, so a refrigeration system is needed to remove it to maintain the temperature within the sulfuric acid solution tank.

In the prior art, a typical refrigeration system applied in the alumina industry is designed with series anti-corrosion evaporators and heat exchange tubes made of corrosion-resistant materials, which is huge in initial investment, high in operation risks, difficult in maintenance, high in cost and short in service lift, which is not an optimized solution for users, especially for the annual operation.

SUMMARY OF THE INVENTION

The invention provides a refrigeration system with which the cost is reduced.

To solve the above technical problems, the present invention adopts the following technical solutions to achieve:

A refrigeration system, wherein the refrigeration system includes: a control module, a chiller, a natural cold source and an intermediate heat exchanger; wherein the chiller includes a compressor, a condenser and an evaporator; a water outlet of the evaporator and a water outlet of the natural cold source are respectively connected to an water inlet of the intermediate heat exchanger and a water inlet of the evaporator and a water inlet of the natural cold source are respectively connected to a water outlet of the intermediate heat exchanger; a liquid inlet of the intermediate heat exchanger is connected to a liquid outlet of a cooling pool, and a liquid outlet of the intermediate heat exchanger is connected to a liquid inlet of the cooling pool;

The control module obtains a lowest temperature $T_{min}$, a highest temperature $T_{max}$ and preset target discharge water temperature of the evaporator $T_o$; and The control module determines whether or not to start the chiller or the natural cooling source according to the $T_{min}$, $T_{max}$ and $T_o$:

(11) If $T_o<T_{min}$, the chiller is started to cool a liquid in the cooling pool;

(12) If $T_o>T_{max}$, the natural cold source is started to cool the liquid in the cooling pool;

(13) If $T_{min}\leq T_o\leq T_{max}$, an actual inlet water temperature $T_i$ at the water inlet of the intermediate heat exchanger is collected every set time period for determining whether or not the actual inlet water temperature $T_i$ satisfies $T_i\geq T_o$−a set value, wherein the set value >0;

if $T_i\geq T_o$−the set value, the chiller is started to cool the liquid in the cooling pool;

if $T_i<T_o$−the set value, the natural cold source is started to cool the liquid in the cooling pool.

Further, user sends a control signal to the control module through a mobile terminal or a touch screen, which is configured to control whether the chiller and the natural cold source are started.

Further, the system includes a cloud service module configured to obtain the lowest temperature $T_{min}$ and the highest temperature $T_{max}$ within one day of a place where the refrigeration system is located via wireless communication.

Further, the water inlet of the condenser is connected to the water outlet of the natural cold source and the water outlet of the condenser is connected to the water inlet of the natural cold source.

Further, when the chiller is started to cool the cooling pool, pipelines between the evaporator and the intermediate heat exchanger are communicated; pipelines between the condenser and the natural cooling source are communicated; pipelines between the intermediate heat exchanger and the natural cold source are blocked; when the natural cold source is started to cool the cooling pool, pipelines between the natural cold source and the intermediate heat exchanger are communicated; pipelines between the condenser and the natural cooling source are blocked; pipelines between the evaporator and the intermediate heat exchanger are blocked.

Further, a filter is provided at the water inlet of the condenser; a filter is provided at the water inlet of the evaporator; a filter is provided at the liquid inlet of the intermediate heat exchanger.

Further, a pH collection module is provided at the water outlet of the intermediate heat exchanger, which is configured to collect a pH and send the collected pH to the control module; the control module determines whether the collected pH at the water outlet is within a preset pH range; if not, an alarm is generated.

Further, a pH collection module is provided at the water outlet the intermediate heat exchanger, which is configured to collect a pH and send the collected pH to the control module; the control module determines whether a difference between the collected pH at the water outlet and a stored average pH of a group of pHs collected in the previous N days is out of a first preset difference range; if yes, an alarm is generated.

Further, pH collection modules are respectively provided at the water outlet and at the water inlet of the intermediate heat exchanger, which are configured to collect a pH and send the collected pH to the control module; the control module determines whether a difference between a collected pH at the water outlet of the intermediate heat exchanger and a collected pH at the water inlet of the intermediate heat exchanger is out of a second preset difference range; if yes, an alarm is generated.

Further, the alarm is a sound alarm, a light alarm or alarm information received at a user mobile terminal.

Compared with the prior art, the advantages and positive effects of the present invention are: the refrigerant system disclosed by the present invention, in which the following process is operated: if the preset target discharge water temperature of the evaporator $T_o$<the lowest temperature $T_{min}$ within one day the chiller is started only to cool the liquid in the cooling pool so as to meet the cooling demand of the cooling pool; if the preset target discharge water temperature of the evaporator $T_o$>the highest temperature $T_{max}$ within one day, the natural cold source is started only to cool the liquid in the cooling pool so as to meet the cooling demand of the cooling pool, which further achieves a purpose of energy saving, thereby reducing the cost; if $T_{min} \leq T_o \leq T_{max}$, further determining whether or not the actual inlet water temperature $T_i$ satisfies $T_i \geq T_o$−a set value: if $T_i \geq T_o$−the set value the chiller is started only to cool the liquid in the cooling pool so as to meet the cooling demand of the cooling pool, or if $T_i < T_o$−the set value, the natural cold source is started only to cool the liquid in the cooling pool so as to meet the cooling demand of the cooling pool, which further achieves a purpose of energy saving.

After reading the specific embodiments of the present invention in conjunction with the accompanying drawings, other features and advantages of the present invention will become clearer.

BRIEF DESCRIPTION OF THE DRAWING

FIG. 1 is a schematic structural diagram of an embodiment of a refrigeration system according to one aspect of the present invention.

REFERENCE NUMBERS

P: Natural cold source;

1: Shutoff valve; 2: Check valve; 3: Shutoff valve; 4: Filter; 5: Water pump;

6: Shutoff valve; 7: Check valve; 8: Shutoff valve; 9: Filter;

10: Water pump; 11: Shutoff valve; 12: Filter; 13: Shutoff valve; 14: Water pump.

DETAILED DESCRIPTION OF THE INVENTION

In order to make the objectives, technical solutions and advantages of the present invention clearer, the following will further describe the present invention in detail with reference to the accompanying drawing and embodiments.

A refrigeration system of the present embodiment mainly includes a control module, a chiller, a natural cold source P, an intermediate heat exchanger, as shown in FIG. 1; wherein the chiller includes a compressor, a condenser, an evaporator and refrigerant circulation pipelines connecting the compressor, the condenser and the evaporator; both of a water outlet of the evaporator and a water outlet of the natural cold source are respectively connected to an water inlet of the intermediate heat exchanger; both of a water inlet of the evaporator and a water inlet of the natural cold source are respectively connected to a water outlet of the intermediate heat exchanger; to be specific, the water outlet of the evaporator is connected to the water inlet of the intermediate heat exchanger through a pipeline, and the water inlet of the evaporator is connected to the water outlet of the intermediate heat exchanger through a pipeline; the water outlet of the natural cold source is connected to the water inlet of the intermediate heat exchanger through a pipeline, and the water inlet of the natural cold source is connected to the water outlet of the intermediate heat exchanger through a pipeline.

A liquid inlet of the intermediate heat exchanger is connected to a liquid outlet of a cooling pool, and a liquid outlet of the intermediate heat exchanger is connected to a liquid inlet of the cooling pool. The cooling pool contains a liquid to be cooled; the liquid to be cooled flows into the liquid inlet of the intermediate heat exchanger via the liquid outlet of the cooling pool; the liquid exchanges heat in the intermediate heat exchanger and flows out from the liquid outlet of the intermediate heat exchanger to the liquid inlet of the cooling pool, that is to circulate back to the cooling pool.

The control module obtains a lowest temperature $T_{min}$ and a highest temperature $T_{max}$ of a place where the refrigeration system is located within one day and further obtains a preset target discharge water temperature of the evaporator $T_o$, and the control module determines whether or not to start the chiller or the natural cooling source according to the $T_{min}$, $T_{max}$ and $T_o$:

(11) If $T_o < T_{min}$, it means that the preset target discharge water temperature of the evaporator is lower than the lowest temperature within one day. Because generally a temperature of the natural cold source is not much different from an air temperature, under this condition the natural cold source is incapable of satisfying a cooling demand of the cooling pool. Accordingly it is determined that the natural cold source is not activated and the chiller is started only to cool the liquid in the cooling pool so as to meet the cooling demand of the cooling pool; chilled water flows from the water outlet of the evaporator to the intermediate heat exchanger through the pipeline, exchanges heat with a solution in the intermediate heat exchanger, and then flows into the water inlet of the evaporator again to complete a cycle.

(12) If $T_o > T_{max}$, it means that the preset target discharge water temperature of the evaporator is greater than the highest temperature within one day. Because generally the temperature of the natural cold source is not much different from the air temperature, under this condition the natural cold source is capable of satisfying the cooling demand of the cooling pool. Accordingly it is determined that the chiller is not activated and the natural cold source is started only to cool the liquid in the cooling pool so as to meet the cooling demand of the cooling pool, which further achieves a purpose of energy saving; chilled water flows from the water outlet of the natural cold source to the intermediate heat exchanger through the pipeline, exchanges heat with a solution in the intermediate heat exchanger, and then flows into the water inlet of the natural cold source again to complete a cycle.

(13) If $T_{min} \leq T_o \leq T_{max}$, it means that the preset target discharge water temperature of the evaporator is greater than the lowest temperature within one day but lower than the highest temperature within one day; an actual inlet water temperature $T_i$ at the water inlet of the intermediate heat exchanger is collected every set time period to determine whether or not the actual inlet water temperature $T_i$ satisfies $T_i \geq T_o$−a set value, wherein the set value >0.

If $T_i \geq T_o$−the set value, it indicates that the inlet water temperature of the intermediate heat exchanger is comparatively high, and accordingly it is determined that the natural cold source is not activated and the chiller is started only to cool the liquid in the cooling pool so as to meet the cooling demand of the cooling pool;

If $T_i<T_o$–the set value, it indicates that the inlet water temperature of the intermediate heat exchanger is comparatively low, and accordingly it is determined that the chiller is not activated and the natural cold source is started only to cool the liquid in the cooling pool so as to meet the cooling demand of the cooling pool, which further achieves a purpose of energy saving.

In the present embodiment, the set value is selected according to a practical demand and a cooling capacity loss via the pipeline, for example, the set value could be in a range from 2° C. to 5° C. In this embodiment, the set time period is in a range from 5 minutes to 10 minutes; and the preferable range for the set time period could not only avoid too frequent judgments to cause a frequent start and stop of the chiller, but also prevent untimely judgments caused by excessive values.

The refrigerant system disclosed by the present embodiment, in which the following process is operated: if the preset target discharge water temperature of the evaporator $T_o$<the lowest temperature $T_{min}$ within one day the chiller is started only to cool the liquid in the cooling pool so as to meet the cooling demand of the cooling pool; if the preset target discharge water temperature of the evaporator $T_o$>the highest temperature $T_{max}$ within one day, the natural cold source is started only to cool the liquid in the cooling pool so as to meet the cooling demand of the cooling pool, which further achieves a purpose of energy saving, thereby reducing the cost; if $T_{min}\leq T_o\leq T_{max}$, further determining whether or not the actual inlet water temperature $T_i$ satisfies $T_i\geq T_o$–a set value: if $T_i\geq T_o$–the set value the chiller is started only to cool the liquid in the cooling pool so as to meet the cooling demand of the cooling pool, or if $T_i<T_o$–the set value, the natural cold source is started only to cool the liquid in the cooling pool so as to meet the cooling demand of the cooling pool, which further achieves a purpose of energy saving.

Moreover, since the natural cold source could be used to cool the cooling pool, taking the annual operation of the refrigeration system into consideration, the operating time of the chiller is shortened, the service life of the chiller is greatly extended, and the operating cost is greatly reduced.

In the present embodiment the preset target discharge water temperature of the evaporator $T_o$ is determined on the basis of a required temperature $T_{need}$ for the cooling pool. As an example, it is preferably to set the preset target discharge water temperature of the evaporator $T_o=T_{need}$, that is to say when $T_{need}$ is 20° C., $T_o$ is 20° C.

The refrigeration system of this embodiment could be applied in the alumina industry, wherein the cooling pool is a sulfuric acid pool, the liquid to be cooled is sulfuric acid, and both of the chiller and natural cold source are used to cool the sulfuric acid in the cooling pool. The required temperature of sulfuric acid in the sulfuric acid pool is in a range from 18 to 22° C. The refrigeration system of this embodiment also could be applied to other industries, and the cooling pool can also contain other liquids that need to be cooled.

In this embodiment, the natural cold source is a cooling tower to provide cold energy.

Because refrigerant circulates in the chiller and the chiller does not need to exchange heat with the liquid in the cooling pool directly, ordinary types of heat exchanger could be used as either of the condenser or the evaporator instead of those made of corrosion-resistant materials or those been through anti-corrosion treatments, and therefore the investment cost is low, there is no risk of corrosion, the cost of the chiller is reduced, the service life of the refrigerant system is prolonged to at least 30 years under normal operation, the annual operating cost is low, and the energy saving effect is significant. But if the liquid in the cooling pool is corrosive, a corrosion-resistant heat exchanger is preferred to serve as the intermediate heat exchanger.

Users further could control the activation of the chiller or the natural cold source through a mobile terminal or a touch screen in order to facilitate operation. The mobile terminal or the touch screen is communicated with the control module. The user sends a control signal to the control module through the mobile terminal or the touch screen to control whether the chiller and the natural cold source are started. The touch screen or mobile terminal displays various operating status of the chiller. The user can perform various operations through the mobile terminal or touch screen according to the actual operating conditions to start the chiller or the natural cold source.

In the present embodiment, the refrigeration system further includes a cloud service module configured to obtain the lowest temperature $T_{min}$ and the highest temperature $T_{max}$ within one day (0-24 h) of the place where the refrigeration system is located via wireless communication. The control module communicates with the cloud service module to access the cloud service module, so as to obtain $T_{min}$ and $T_{max}$. By setting the cloud service module, the accurate $T_{min}$ and $T_{max}$ can be obtained conveniently and timely.

In order to make full use of the natural cold source and further achieve a purpose of energy saving, the condenser is a water-cooled condenser. The water inlet of the condenser is connected to the water outlet of the natural cold source through a pipeline, and the water outlet of the condenser is connected to the water inlet of the natural cold source through a pipeline, so as to use the natural cold source to cool the condenser.

Further, a filter 4 is provided at the water inlet of the condenser to filter out impurities; a filter 9 is provided at the water inlet of the evaporator to filter out impurities; and a filter 12 is provided at the liquid inlet of the intermediate heat exchanger to filter out impurities.

Specifically, a shutoff valve 1 and a check valve 2 are provided on a pipeline between a water outlet of the condenser and the water inlet of the natural cold source, and a pipeline between a water inlet of the condenser and the water outlet of the natural cold source is provided with a shutoff valve 3, the filter 4, a water pump 5 and an electric ball valve MV3. A shutoff valve 6 and a check valve 7 are provided on the pipeline between the water outlet of the evaporator and the water inlet of the intermediate heat exchanger, and a shutoff valve 8, the filter 9 and an electric ball valve MV4 are arranged on the pipeline between the water inlet of the evaporator and the water outlet of the intermediate heat exchanger. An electric ball valve MV1 is arranged on the pipeline between the water inlet of the natural cold source and the water outlet of the intermediate heat exchanger; an electric ball valve MV2 is arranged on the pipeline between the water outlet of the natural cold source and the water inlet of the intermediate heat exchanger. The filter 12 and a shutoff valve 13 are arranged on the pipeline between the liquid inlet of the intermediate heat exchanger and the liquid outlet of the cooling pool, and the pipeline between the liquid outlet of the intermediate heat exchanger and the liquid inlet of the cooling pool is arranged a water pump 10 and a shutoff valve 11. The chiller in the present embodiment can be a magnetic levitation unit, a screw unit, or an ordinary centrifugal unit. The electric ball valves of the present embodiment can also be replaced by other equivalent valves capable of being automatically switched in conjunction with the refrigerant system. The water pump in the present embodiment includes an ordinary fixed frequency water pump and a variable frequency water pump so as to adjust the flow or flow rate of water or liquid in the cooling pool.

When the chiller is started to cool the cooling pool, the pipelines between the intermediate heat exchanger and the cooling pool are communicated (namely the shutoff valve 11 and the shutoff valve 13 are opened); the pipelines between the evaporator and the intermediate heat exchanger are communicated (namely the shutoff valve 6, the shutoff valve 8 and the electric ball valve MV4 are opened); the pipelines between the condenser and the natural cooling source are communicated (namely the shutoff valve 1, the shutoff valve 3 and the electric ball valve MV3 are opened); but the pipelines between the intermediate heat exchanger and the natural cold source are blocked (namely the electric ball valves MV1 and MV2 are closed), so as to enable the configuration to meet the cooling demand of the cooling pool by the chiller. Water from the outlet of the condenser flows through the shutoff valve 1 and the check valve 2 in turn to the water inlet of the natural cold source, and then enters the natural cold source; water from the water outlet of the natural cold source flows through the electric ball valve MV3, the water pump 5, the filter 4, the shutoff valve 3 in turn to the water inlet of the condenser, and then enters the condenser to complete a cycle. Chilled water from the water outlet of the evaporator flows through the shutoff valve 6 and the check valve 7 in succession to the water inlet of the intermediate heat exchanger and enters the intermediate heat exchanger to exchange heat; water emanates from the water outlet of the intermediate heat exchanger through the water pump 14, the electric ball valve MV4, the filter 9, and the shutoff valve 8 in turn to the water inlet of the evaporator, and then enters the evaporator to complete a cycle. Liquid coming from the liquid outlet of the cooling pool flows through the shutoff valve 13 and the filter 12 to the liquid inlet of the intermediate heat exchanger and then enters the intermediate heat exchanger to exchange heat; liquid emanates from the liquid outlet of the intermediate heat exchanger through the water pump 10 and the shutoff valve 11 in turn to the liquid inlet of the cooling pool and then enters the cooling pool to complete a cycle. Therefore, the liquid in the cooling pool and the water flowing out from the evaporator exchange heat in the intermediate heat exchanger to realize the cooling of the liquid in the cooling pool by the chiller.

When the natural cold source is started to cool the cooling pool, the pipelines between the intermediate heat exchanger and the cooling pool are communicated (namely the shutoff valve 11 and the shutoff valve 13 are opened); the pipelines between the natural cold source and the intermediate heat exchanger are communicated (namely the electric ball valves MV1 and MV2 are opened), but the pipelines between the condenser and the natural cooling source are blocked (namely the shutoff valve 1, the shutoff valve 3, and the electric ball valve MV3 are closed); the pipelines between the evaporator and the intermediate heat exchanger are blocked (namely the shutoff valve 6, the shutoff valve 8, and the electric ball valve MV4 are closed); the configuration does not only meet the cooling demand of the cooling pool, but also realize a purpose of energy saving. Water from the water outlet of the natural cold source flows through the electric ball valve MV2 to the water inlet of the intermediate heat exchanger and enters the intermediate heat exchanger to exchange heat; water emanates from the water outlet of the intermediate heat exchanger through the water pump 14 and the electric ball valve MV1 in turn to the natural cold source and then enters the natural cold source to complete a cycle. Liquid coming from the liquid outlet of the cooling pool flows through the shutoff valve 13 and the filter 12 to the liquid inlet of the intermediate heat exchanger and then enters the intermediate heat exchanger to exchange heat; liquid emanates from the liquid outlet of the intermediate heat exchanger through the water pump 10 and the shutoff valve 11 in turn to the liquid inlet of the cooling pool and then enters the cooling pool to complete a cycle. Therefore, the liquid in the cooling pool and the water flowing out from the natural cold source exchange heat in the intermediate heat exchanger to realize the cooling of the liquid in the cooling pool by the natural cold source and achieve a purpose of energy saving.

In the present embodiments, valves are used to direct or control the flow in each pipeline so as to realize the selection of a chiller or a natural cold source to cool the cooling pool.

As a preferred embodiment, in order to detect corrosion and eventual leakage in the intermediate heat exchanger in time, a pH collection module (a pH sensor shown as pH1 in FIG. 1) is provided at the water outlet of the intermediate heat exchanger, which is configured to collect a pH and send the collected pH to the control module. The control module receives and saves the pH, or further sends the pH to a server to store. The control module determines whether the collected pH at the water outlet is within a preset pH range; if the collected pH is out of the preset pH range, it indicates that the collected pH is abnormal which further means a potential corrosion leakage may occur in the intermediate heat exchanger, and an alarm will be generated to remind the user of inspection, so as to ensure the safety of the entire system and the user, eliminate potential risks while using the system, facilitate maintenance and reduce maintenance costs.

For example, if a normal chilled water pH range of 6 to 9, the preset pH range could be 6 to 9. Definitely preset pH range could be modified according to actual operation conditions. The alarm could be a sound alarm, a light alarm or alarm information received at a mobile terminal at the user's end or a plurality of warning signals to remind the user.

As another preferred embodiment, in order to detect corrosion and eventual leakage in the intermediate heat exchanger in time, a pH collection module (a pH sensor shown as pH1 in FIG. 1) is provided at the water outlet of the intermediate heat exchanger, which is configured to collect a pH and send the collected pH to the control module. The control module receives and saves the pH, or further sends the pH to a server to store. The control module determines whether a difference between the collected pH at the water outlet and a stored average pH of a group of pHs collected in the previous N days is out of a first preset difference range, wherein N>0; if the difference between the collected pH at the water outlet and the stored average pH of a group of pHs collected in the previous N days is out of the first preset difference range, it indicates that the collected pH is abnormal which further means a potential corrosion leakage may occur in the intermediate heat exchanger, and an alarm will be generated to remind the user of inspection, so as to ensure the safety of the entire system and the user, eliminate potential risks while using the system, facilitate maintenance and reduce maintenance costs.

The stored average pH of a group of pHs collected in the previous N days refers to an average of a group of pHs which are in the preset pH range collected and stored in the previous N days, and wherein N could be set by the user randomly. In the present embodiment, the first preset difference range is of −0.5 to 0.5, which also could be set according to actual working conditions. The alarm could be a sound alarm, a light alarm or alarm information received at a user mobile terminal or a plurality of warning signals to remind the user.

As another preferred embodiment, in order to detect corrosion and eventual leakage in the intermediate heat exchanger in time, a pH collection module (a pH sensor shown as pH1 in FIG. 1) is provided at the water outlet of the intermediate heat exchanger, which is configured to collect a pH and send the collected pH to the control module; another pH collection module (a pH sensor shown as pH2 in FIG. 1) is provided at the water inlet of the intermediate heat exchanger which is configured to collect a pH and send the collected pH to the control module. The control module receives and saves the pH, or further sends the pH to a server to store. The control module determines whether a difference between a collected pH at the water outlet of the intermediate heat exchanger and a collected pH at the water inlet of the intermediate heat exchanger is out of a second preset difference range; if the difference between the collected pH at the water outlet of the intermediate heat exchanger and the collected pH at the water inlet of the intermediate heat exchanger is out of the second preset difference range, it indicates that an absolute value of the pH at the water outlet of the intermediate heat exchanger and the pH at the water inlet of the intermediate heat exchanger is comparatively larger, it is determined that a potential corrosion leakage may occur in the intermediate heat exchanger, and an alarm will be generated to remind the user of inspection, so as to ensure the safety of the entire system and the user, eliminate potential risks while using the system, facilitate maintenance and reduce maintenance costs.

Under normal circumstances that the intermediate heat exchanger does not leak, the pH at the water outlet and the pH at the water inlet should be the same. In the present embodiment, the second preset difference range is −1 to 1, which also could be set according to actual working conditions. The alarm could be a sound alarm, a light alarm or alarm information received at a mobile terminal at the user's end or a plurality of warning signals to remind the user.

The refrigeration system disclosed by the present embodiment could greatly reduce initial investment, reduce operational risks, simplify maintenance, lower the cost, and prolong service life, which is one of the most energy-saving solutions for operation throughout the year.

The above embodiments are only used to illustrate the technical solutions of the present invention, but not to limit them; although the present invention has been described in detail with reference to the foregoing embodiments, for those of ordinary skill in the art, the technical solutions of the foregoing embodiments can still be described. The recorded technical solutions are modified, or some of the technical features are equivalently replaced; these modifications or replacements do not cause the essence of the corresponding technical solutions to deviate from the spirit and scope of the technical solutions claimed by the present invention.

The invention claimed is:

1. A refrigeration system, wherein the refrigeration system includes: a control module, a chiller, a natural cold source and an intermediate heat exchanger; wherein the chiller includes a compressor, a condenser and an evaporator; a water outlet of the evaporator and a water outlet of the natural cold source are respectively connected to a water inlet of the intermediate heat exchanger and a water inlet of the evaporator and a water inlet of the natural cold source are respectively connected to a water outlet of the intermediate heat exchanger; a liquid inlet of the intermediate heat exchanger is connected to a liquid outlet of a cooling pool, and a liquid outlet of the intermediate heat exchanger is connected to a liquid inlet of the cooling pool;

the control module obtains a lowest temperature $T_{min}$, a highest temperature $T_{max}$ and preset target discharge water temperature of the evaporator $T_o$; and the control module determines whether or not to start the chiller or the natural cooling source according to the $T_{min}$, $T_{max}$ and $T_o$:

(11) if $T_o<T_{min}$, the chiller is started to cool a liquid in the cooling pool;

(12) if $T_o>T_{max}$, the natural cold source is started to cool the liquid in the cooling pool;

(13) if $T_{min}\leq T_o\leq T_{max}$, an actual inlet water temperature $T_i$ at the water inlet of the intermediate heat exchanger is collected every set time period for determining whether or not the actual inlet water temperature $T_i$ satisfies $T_i\geq T_o-$a set value, wherein the set value >0;

if $T_i\geq T_o-$the set value, the chiller is started to cool the liquid in the cooling pool;

if $T_i<T_o-$the set value, the natural cold source is started to cool the liquid in the cooling pool.

2. The system according to claim 1, wherein, user sends a control signal to the control module through a mobile terminal or a touch screen, which is configured to control whether the chiller and the natural cold source are started.

3. The system according to claim 1, wherein, the system further includes a cloud service module configured to obtain the lowest temperature $T_{min}$ and the highest temperature $T_{max}$ within one day of a place where the refrigeration system is located via wireless communication.

4. The system according to claim 1, wherein, a water inlet of the condenser is connected to a water outlet of the natural cold source and the water outlet of the condenser is connected to the water inlet of the natural cold source.

5. The system according to claim 4, wherein, when the chiller is started to cool the cooling pool, pipelines between the evaporator and the intermediate heat exchanger are communicated; pipelines between the condenser and the natural cooling source are communicated; pipelines between the intermediate heat exchanger and the natural cold source are blocked;

when the natural cold source is started to cool the cooling pool, pipelines between the natural cold source and the intermediate heat exchanger are communicated; pipelines between the condenser and the natural cooling source are blocked; pipelines between the evaporator and the intermediate heat exchanger are blocked.

6. The system according to claim 1, wherein a filter is provided at a water inlet of the condenser; a filter is provided at the water inlet of the evaporator; a filter is provided at the liquid inlet of the intermediate heat exchanger.

7. The system according to claim 1, wherein a pH collection module is provided at the water outlet of the intermediate heat exchanger, which is configured to collect a pH and send the collected pH to the control module;

the control module determines whether the collected pH at the water outlet is within a preset pH range;

if not, an alarm is generated.

8. The system according to claim 7, wherein the alarm is a sound alarm, a light alarm and/or alarm information received at a user mobile terminal.

9. The system according to claim 1, wherein a pH collection module is provided at the water outlet the intermediate heat exchanger, which is configured to collect a pH and send the collected pH to the control module;

the control module determines whether a difference between the collected pH at the water outlet and a stored average pH of a group of pHs collected in previous N days is out of a first preset difference range; wherein N>0;

if yes, an alarm is generated.

10. The system according to claim 9, wherein the alarm is a sound alarm, a light alarm and/or alarm information received at a user mobile terminal.

11. The system according to claim 1, wherein pH collection modules are respectively provided at the water outlet and at the water inlet of the intermediate heat exchanger, which are configured to collect pHs and send the collected pHs to the control module;

the control module determines whether a difference between a collected pH at the water outlet of the intermediate heat exchanger and a collected pH at the water inlet of the intermediate heat exchanger is out of a second preset difference range;

if yes, an alarm is generated.

12. The system according to claim 11, wherein the alarm is a sound alarm, a light alarm and/or alarm information received at a user mobile terminal.

* * * * *